US007625079B2

(12) United States Patent
Katada

(10) Patent No.: US 7,625,079 B2
(45) Date of Patent: Dec. 1, 2009

(54) INK TANK AND INK-JET RECORDING APPARATUS

(75) Inventor: Masahito Katada, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 419 days.

(21) Appl. No.: 11/387,922

(22) Filed: Mar. 24, 2006

(65) Prior Publication Data

US 2006/0221152 A1 Oct. 5, 2006

(30) Foreign Application Priority Data

Mar. 30, 2005 (JP) ..... 2005-099472

(51) Int. Cl.
*B41J 2/175* (2006.01)

(52) U.S. Cl. ..... 347/86

(58) Field of Classification Search ..... None
See application file for complete search history.

(56) References Cited

U.S. PATENT DOCUMENTS 5,489,932 A * 2/1996 Ceschin et al. ..... 347/87
5,622,308 A * 4/1997 Ito et al. ..... 229/198.2
6,071,366 A * 6/2000 Yamada et al. ..... 156/218
6,361,136 B1 * 3/2002 Watanabe et al. ..... 347/7
6,412,929 B1 * 7/2002 Chen ..... 347/86
6,490,792 B1 * 12/2002 Ishinaga et al. ..... 29/890.1
6,540,314 B1 * 4/2003 Sanada et al. ..... 347/7
2002/0051045 A1 * 5/2002 Koshikawa et al. ..... 347/86
2003/0227525 A1 * 12/2003 Kim et al. ..... 347/87
2004/0009294 A1 * 1/2004 Kuribayashi et al. ..... 427/212
2004/0104949 A1 * 6/2004 Morita et al. ..... 347/7

FOREIGN PATENT DOCUMENTS

JP 10-114082 A 5/1998
JP 11130048 A * 5/1999

* cited by examiner

*Primary Examiner*—Stephen D Meier
*Assistant Examiner*—Alexander C Witkowski
(74) *Attorney, Agent, or Firm*—Birch, Stewart, Kolasch & Birch, LLP.

(57) ABSTRACT

An ink cartridge for supplying an ink to an ink jet type recording head is made of a paper box formed with an ink chamber. Inner wall surfaces of the ink chamber are processed to have water-repellency. The ink chamber is partitioned into a storage chamber storing the ink and an ink absorbent chamber containing an ink absorbent made of unwoven fabric. An ink outlet is formed in a bottom wall of the ink chamber. The ink outlet may be formed as a thin wall part with no water-repellency, so the ink percolates through the thin wall part. An ink run-out detection window is formed in the storage chamber. The ink run-out detection window may be a thin wall part or consist of an opening and a translucent paper sheet covering the opening.

15 Claims, 6 Drawing Sheets

INK TANK AND INK-JET RECORDING APPARATUS

FIELD OF THE INVENTION

The present invention relates to an ink tank containing an ink to be supplied to an ink-jet type recording head, and an ink-jet recording apparatus using the ink tank.

BACKGROUND OF THE INVENTION

An ink-jet recording apparatus has been known, which has a recording head for discharging ink as droplets onto a recording paper to print an image. The ink-jet recording apparatus is provided with at least an ink tank containing an ink, to supply the ink from the ink tank to the recording head. In a serial ink-jet recording apparatus, a recording head is mounted to a carriage, so the recording head is moved with the carriage in a widthwise direction of a recording paper, to record an image.

Because the ink is a consumable material, the ink tank is often formed as a cartridge that is removably attached to the ink-jet recording apparatus, so as to make it easy to supplement the ink-jet recording apparatus with the ink. Such a cartridge type ink tank, hereinafter called the ink cartridge, is replaced with another that is fully filled with the ink, when the ink contained in the ink cartridge is used up. For use with the ink cartridge, a carriage of the ink-jet recording apparatus is provided with a cartridge loading portion in a place above a recording head, so the ink cartridge is removably attached to the cartridge loading portion. In many of the ink-jet recording apparatuses, the ink cartridge is placed above the recording head.

Where the ink cartridge is placed above the recording head, it is necessary to keep pressure in an ink chamber of the ink tank or cartridge negative relative to atmospheric pressure. This is because an outlet of each ink ejection nozzle of the recording head, which is connected to the ink chamber, is open to the atmosphere, so the ink will leak out of the outlet of the nozzle due to the weight of the ink, if the ink chamber and the nozzle are not under a negative pressure to the atmosphere. As an easy way to generate a negative pressure in the ink chamber, an ink absorbent is conventionally disposed in the ink chamber. The ink absorbent absorbs and holds the ink by its capillary force.

Meanwhile, the ink cartridge has mainly been made of plastics. After being used up, the ink cartridge is thrown away or collected by its manufacturer or the like for the sake of reusing it. In order to reduce environmental pollution and environmental load, it has been suggested making an ink cartridge of paper. For example, Japanese Laid-open Patent Application No. 10-114082 suggests an ink cartridge that consists of a paper container containing an ink and a casing that holds the paper container and an ink absorbent.

Although the container is made of paper in this prior art, the casing and the ink absorbent are made of other materials than paper. As a material for the ink absorbent, urethane foam is often used. The casing is usually made of plastics. Urethane foam and plastics are both incombustible, and give greater load on the environment in comparison with natural materials like paper. Social demands for reducing the environmental load have recently been increasing, so it is desirable to provide an ink cartridge that reduces the load on the environment.

SUMMARY OF THE INVENTION

In view of the foregoing, a primary object of the present invention is to provide an ink tank that reduces the environmental load.

Another object of the present invention is to provide an ink-jet recording apparatus for use with the ink tank of the present invention.

An ink tank of the present invention comprises a paper box formed with an ink chamber for containing the ink, an ink outlet through which the ink is supplied from the ink chamber to the recording head, and an air inlet through which air is introduced into the ink chamber; and an ink absorbent contained in the ink chamber, the ink absorbent absorbing and holding the ink by a capillary force, thereby to generate a negative pressure in the ink chamber.

The ink absorbent is preferably made of unwoven fabric. The unwoven fabric is made from a combustible cellulose material including natural fiber and reproduced fiber that is reproduced from the natural fiber. The unwoven fabric is preferably folded up into concertinas as being contained in the ink absorbent chamber.

According to a preferred embodiment, the ink chamber has an ink run-out detection window in a peripheral wall, for detecting that the ink has run out from the ink chamber. The ink run-out detection window is preferably formed by thinning a part of the peripheral wall. Alternatively, the ink run-out detection window comprises an opening formed through the peripheral wall and a translucent paper sheet covering the opening.

The ink tank of the present invention is preferably formed as a cartridge that is removably attachable to an ink-jet recording apparatus having the recording head. It is preferable to dispose an ink run-out sensor is disposed in a position corresponding to the ink run-out detection window of the ink tank, for detecting optically a residual amount of the ink in the ink chamber.

Constituting the ink chamber of the paper box makes it easy to dispose of or recycle the used ink tank, and thus reduces the load on the environment, in comparison with the cases where the ink chamber is made of plastics.

Making the ink absorbent of the unwoven fabric that is made from a combustible cellulose material further reduces the environmental load.

BRIEF DESCRIPTION OF THE DRAWINGS

The above and other objects and advantages will be more apparent from the following detailed description of the preferred embodiments when read in connection with the accompanied drawings, wherein like reference numerals designate like or corresponding parts throughout the several views, and wherein.

DESCRIPTION OF THE PREFERRED EMBODIMENTS

Figure 1:
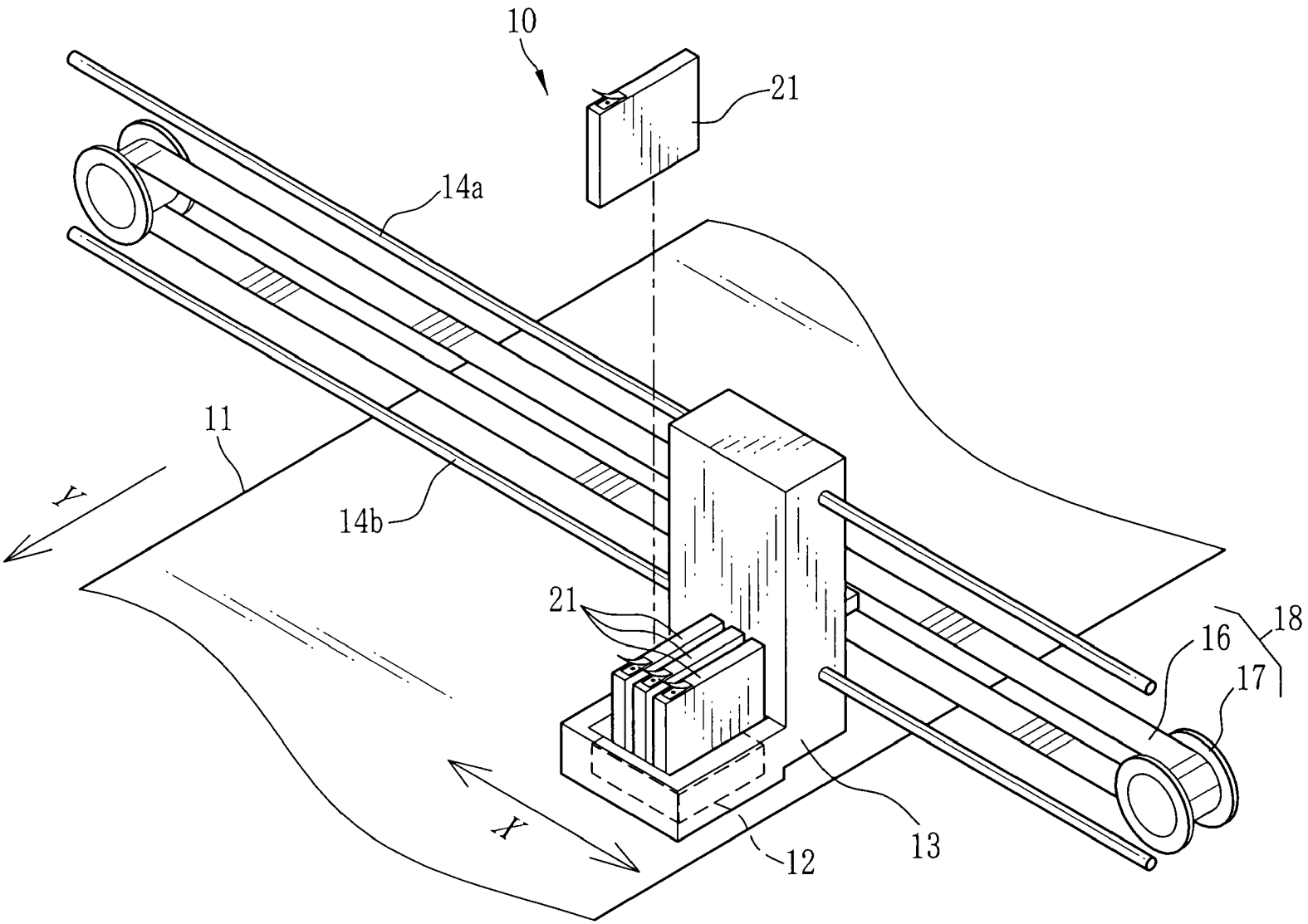
FIG. 1 is an explanatory diagram illustrating essential elements of an ink-jet recording apparatus according to an embodiment of the invention.

An ink-jet recording apparatus 10 shown in FIG. 1 is provided with a recording head 12 that discharges ink toward a recording paper 11 to print images thereon. The recording head 12 is provided with a plurality of not-shown nozzles for discharging the ink from individual outlets. The outlets of the nozzles are aligned in a plane to form a discharging surface, and the discharging surface is placed in face to a recording surface of the recording paper 11. The recording head 12 is mounted in a carriage 13 that is movable in a widthwise direction of the recording paper 11, that is, a main scanning direction X. The discharging surface is exposed through an opening formed through a bottom of the carriage 13. While reciprocating in the widthwise direction of the recording paper 11 together with the carriage 13, the recording head 12 records an image serially line after line. Each time the recording head 12 makes one lap to record a line of the image, the recording paper 11 is fed by not-shown conveyer rollers in a sub scanning direction Y, that is orthogonal to the main scanning direction X, by a length corresponding to a width of each image line as recorded by the recording head 12. Thus, the image is recorded line by line.

The carriage 13 is mounted on a pair of guide rods 14*a* and 14*b* to slide thereon, and is driven by a belt mechanism 18 consisting of a belt 16 and a pair of pulleys 17. The carriage 13 carries ink cartridges 21, e.g. four cartridges containing inks of four different colors: yellow, magenta, cyan and black.

Figure 2:
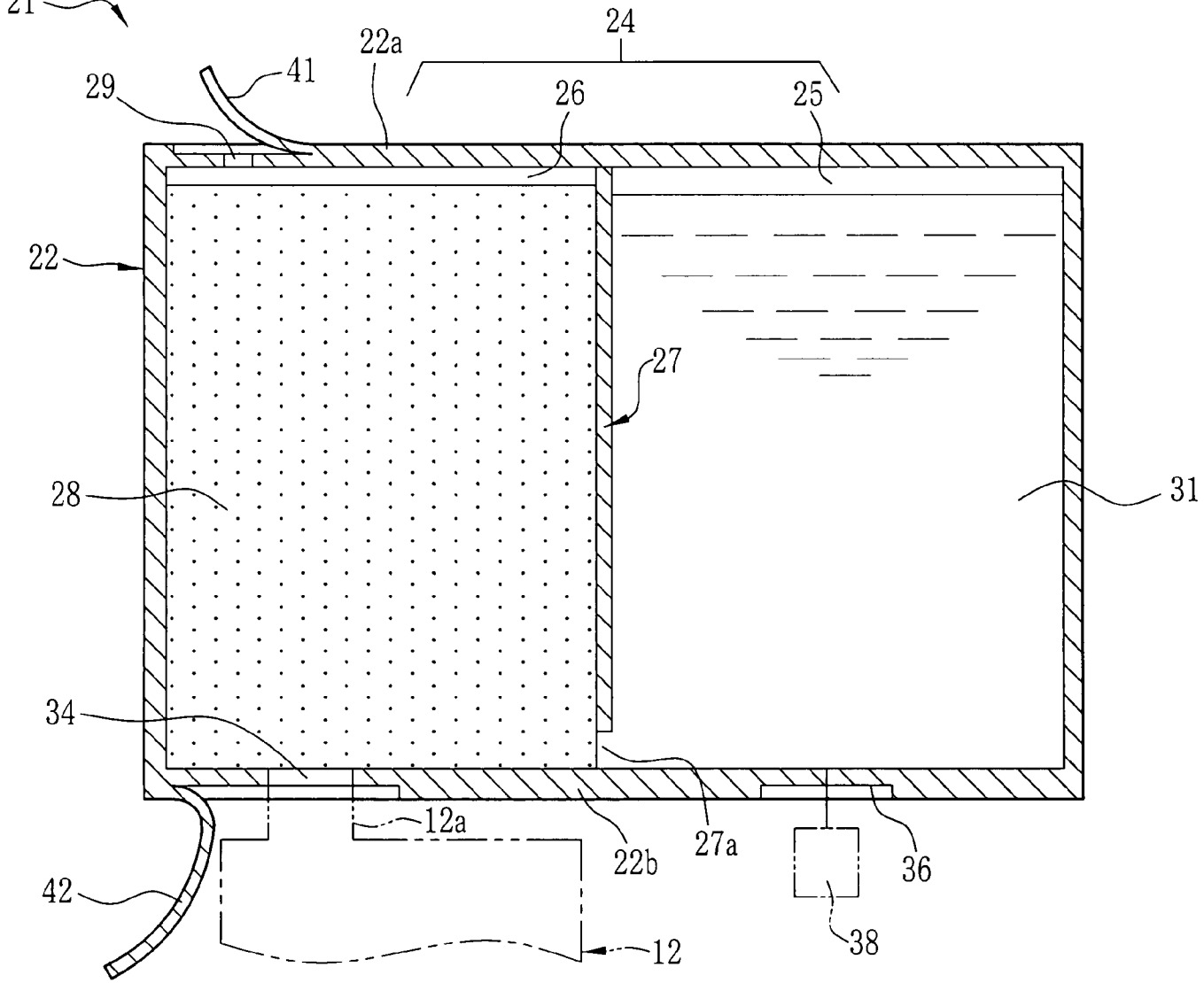
FIG. 2 is a schematic sectional view of an ink cartridge according to an embodiment of the invention.

The carriage 13 is provided with not-shown slots, into which the ink cartridges 21 are plugged. When the ink cartridge 21 is plugged in the slot, an ink outlet 34 formed on a bottom of the ink cartridge 21, as shown in FIG. 2, is connected to an ink supply opening 12*a* of the recording head 12, providing an ink supply path. Through the ink supply path, the ink contained in the ink cartridge 21 is supplied to the recording head 12. In the recording head 12, not-shown pressure rooms and oscillation plates are provided in one-to-one relationship with the nozzles. The oscillation plate is driven individually by a piezoelectric element, to change volume of the pressure room. Thereby, the ink in the ink cartridge 21 is sucked into the nozzle, and is ejected from the outlet of the nozzle.

As shown in FIG. 2, the ink cartridge 21 consists of a paper box 22 formed with an ink chamber 24 for storing the ink. The ink chamber 24 includes an ink absorbent chamber 26 holding an ink absorbent 28 that absorbs and holds the ink by its capillary force, and a storage chamber 25 for storing the ink. The ink absorbent chamber 26 and the storage chamber 25 are parted by a partition wall 27, and are interconnected through an interconnection slot 27*a* formed through the partition wall 27 in a portion near the bottom of the ink chamber 24. Thus, the ink absorbent 28 absorbs the ink from the storage chamber 25 through the slot 27*a*.

A top wall 22*a* of the box 22 is formed with an air inlet 29 for introducing the air into the ink absorbent chamber 26. A bottom wall 22*b* of the box 22 is formed with an ink outlet 34 and an ink run-out detection window 36. The ink outlet 34 is located on the bottom of the ink absorbent chamber 26, for sending the ink out of the ink absorbent chamber 26 to supply the ink to the recording head 12. The ink run-out detection window 36 is located on the bottom of the storage chamber 25, for permitting detecting optically that the ink has run out.

The ink outlet 34 is an opening formed through the bottom wall 22*b*, and is located in a position opposing to the ink supply opening 12*a* of the recording head 12 when the ink cartridge 21 is attached to the carriage 13. It is preferable to place a filter in the opening, for filtering the ink. The ink run-out detection window 36 is located in a position opposing to an ink run-out sensor 38 that is mounted to the carriage 13. For example, the ink run-out sensor 38 is a reflective photo sensor that emits a light beam toward the ink run-out detection window 36, and receives a light beam reflected from the ink run-out detection window 36. Thereby, the ink run-out sensor 38 detects as to whether the ink in the storage chamber 25 is used up or not.

In order to prevent leakage of the ink, the air inlet 29 and the ink outlet 34 are sealed with sealing members 41 and 42 respectively, which are formed integrally with the box 22. When attaching the ink cartridge 21 to the carriage 13, the user peals off the sealing members 41 and 42.

For printing, the recording head 12 generates such a suction force against the negative pressure of the ink in the ink chamber 24, that sucks the ink from the ink absorbent chamber 26 and lets the ink be ejected from the outlet of the nozzle. As the recording head 12 sucks the ink, the pressure in the ink absorbent chamber 26 decreases, so the air enters the ink absorbent chamber 26 through the air inlet 29. The ink contained in the ink chamber 24 is consumed first from the portion in the ink absorbent chamber 26, and the ink is supplemented from the storage chamber 25 to the ink absorbent chamber 26. As the ink decreases, the internal pressure of the storage chamber 25 decreases, so the air is taken into the storage chamber 25 through the interconnection slot 27*a*. While repeating air-liquid exchange in this way, the ink is fed to the recording head 12.

Figure 3:
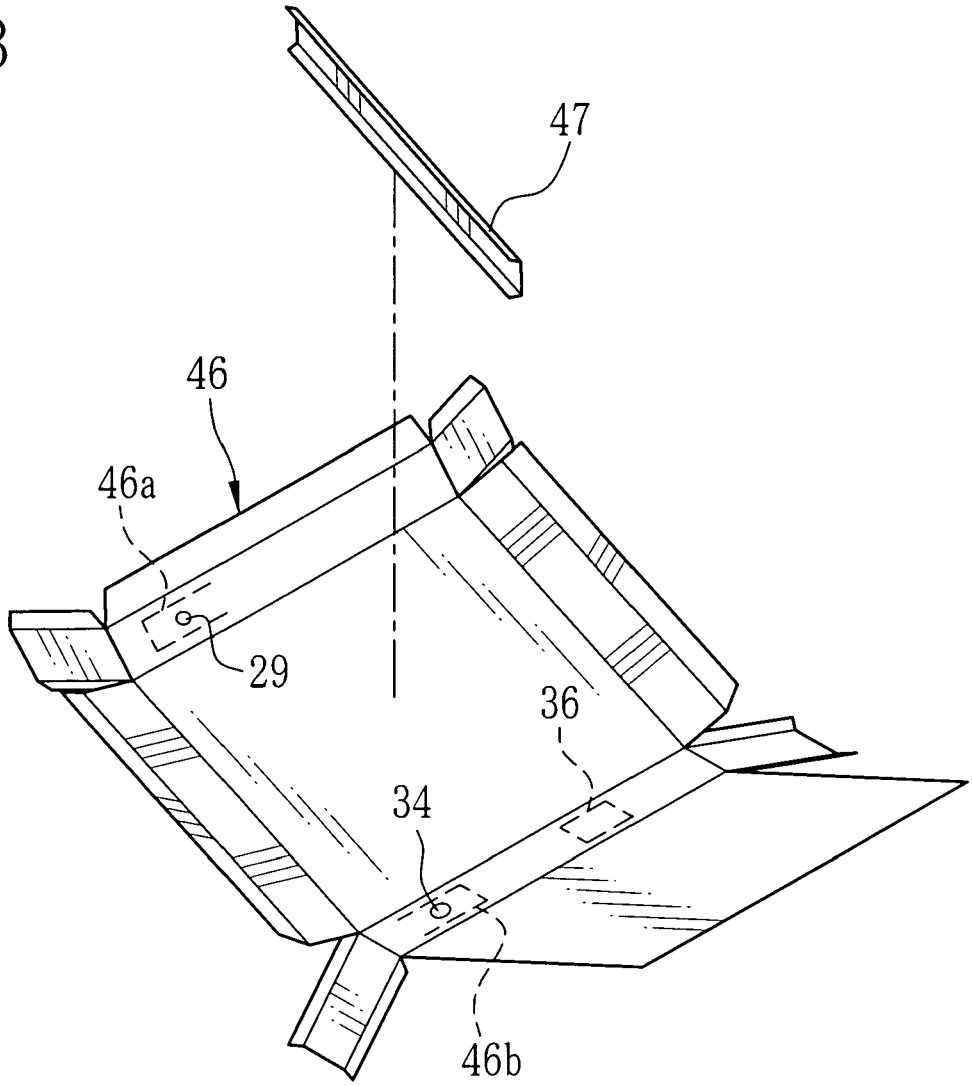
FIG. 3 is an exploded perspective view of a paper box used in the ink cartridge of FIG. 2.

The box 22 is made of a paper sheet 46, as shown for example in FIG. 3, wherein the sheet 46 constitutes peripheral walls of the box 22, consisting of the top wall 22*a*, the bottom wall 22*b* and side walls. A paper strip 47 is affixed to a predetermined position of the sheet 46, to constitute the partition wall 27. The partition wall 27 divides the ink chamber 24 into two sections, which form the storage chamber 25 and the ink absorbent chamber 26. The sheet 46 and the paper strip 47 are, for example, such heavy paper that is used for cartons containing beverages.

The sheet 46 is formed by laminating a number of paper layers, and the sealing members 41 and 42 are formed by partly cutting external ones of the paper layers, which are located outward as the sheet 46 is formed into the box 22, as shown by dashed lines 46*a* and 46*b* in FIG. 3. Forming the sealing members 41 and 42 as parts of the box 22 reduces the total number of parts of the ink cartridge 21. But it is possible to use separate sealing members instead.

Because the ink absorbent chamber 26 and the storage chamber 25 are filled with the ink, the sheet 46 and the paper strip 47 are processed to have water-repellency on those surfaces which form the inner surfaces of the ink absorbent chamber 26 and the storage chamber 25. For example, these surfaces are coated with a transparent water-repellent material, to have a water-repellent layer 52 (see FIG. 5).

Constituting the ink chamber 24, including the ink absorbent chamber 26, of the paper box 22 makes it easy to dispose of or recycle the used ink cartridge 21, and thus reduces the load on the environment, in comparison with the cases where the ink chamber is made of plastics.

The ink absorbent 28 is made of unwoven fabric formed from paper. The unwoven fabric is a sheet formed by bonding fibers in a wet bonding method or a dry bonding method, without weaving the fibers. The material of the unwoven fabric is preferably cellulose fiber, including natural fiber, such as pulp, cotton and hemp, and reproduced fiber that is reproduced from the natural fiber, such as rayon and cupra. The unwoven fabric formed from paper, natural fiber or reproduced fiber contributes to reducing the environmental load. Because the cellulose fiber does not have a melt point, it is burnt out without being melted. The cellulose fiber needs a low calorie of 4000 Kcal to 5000 Kcal for burning, so it will not damage incinerators. Therefore, the ink cartridge 21 of the present invention, including the ink absorbent 28, is disposable as a combustible waste without damaging the environment.

Figure 4:
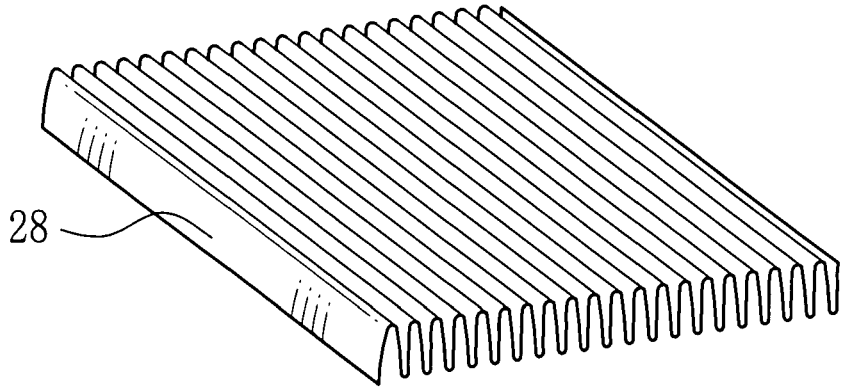
FIG. 4 is a perspective view of an ink absorbent used in the ink cartridge of FIG. 2.

As shown in FIG. 4, the unwoven fabric is folded up into concertinas for use as the ink absorbent 28. But it is possible to fold up the unwoven fabric another way insofar as the unwoven fabric is densely stuffed in the ink absorbent chamber 26. It is also possible to constitute the ink absorbent 28 of a number of sheets of unwoven fabric.

Figure 5:
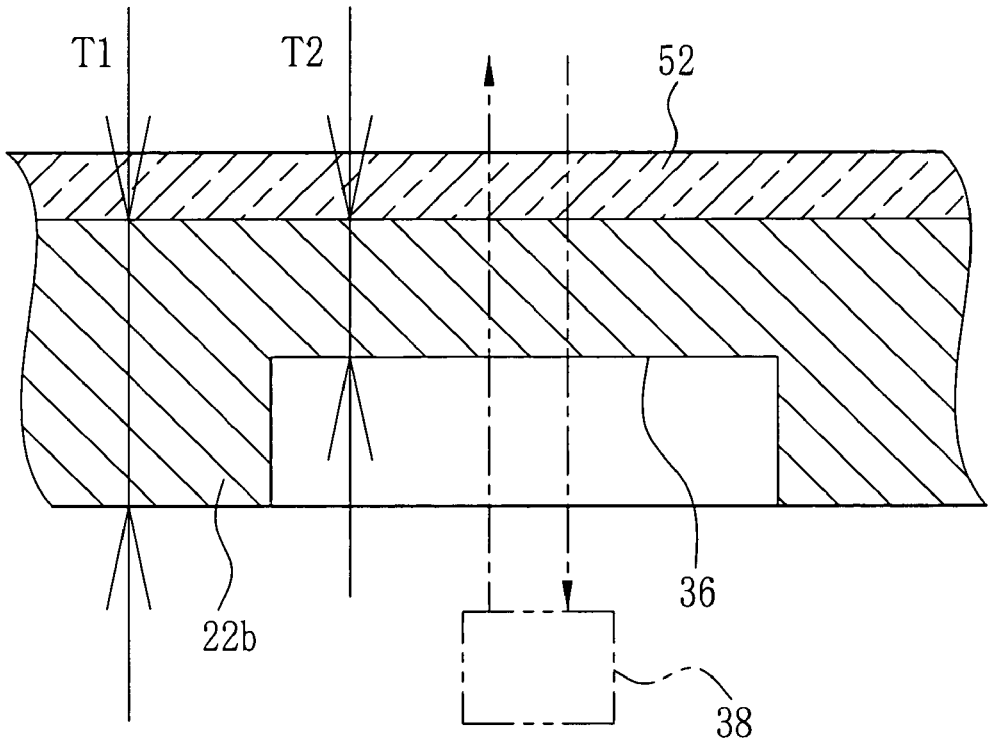
FIG. 5 is a fragmentary sectional view illustrating an ink run-out detection window of the ink cartridge of FIG. 2.

FIG. 5 shows the ink run-out detection window 36 that is formed by thinning an area of the bottom wall 22*b* to have a smaller thickness T2 than a wall thickness T1 of other area. The thickness T2 of the ink run-out detection window 36 is determined to let the light beam from the ink run-out sensor 38 and the reflected light past through the window 36. The light-permeable thickness T2 varies depending upon the quality of the paper used for making the box 22. Although the residual amount of the ink in the storage chamber 25 is detected optically by the ink run-out sensor 38 in the present embodiment, another method may be used for detecting the residual amount of the ink. For example, it is possible to detect the amount of sagging of the ink run-out detection window 36, which varies with the ink weight, as a value indicating the residual amount of the ink.

As described so far, since all parts of the ink cartridge 21, including the ink absorbent chamber 26 and the ink absorbent 28, are made of paper, the load of the ink cartridge 21 on the environment is lighter than conventional.

Figure 6:
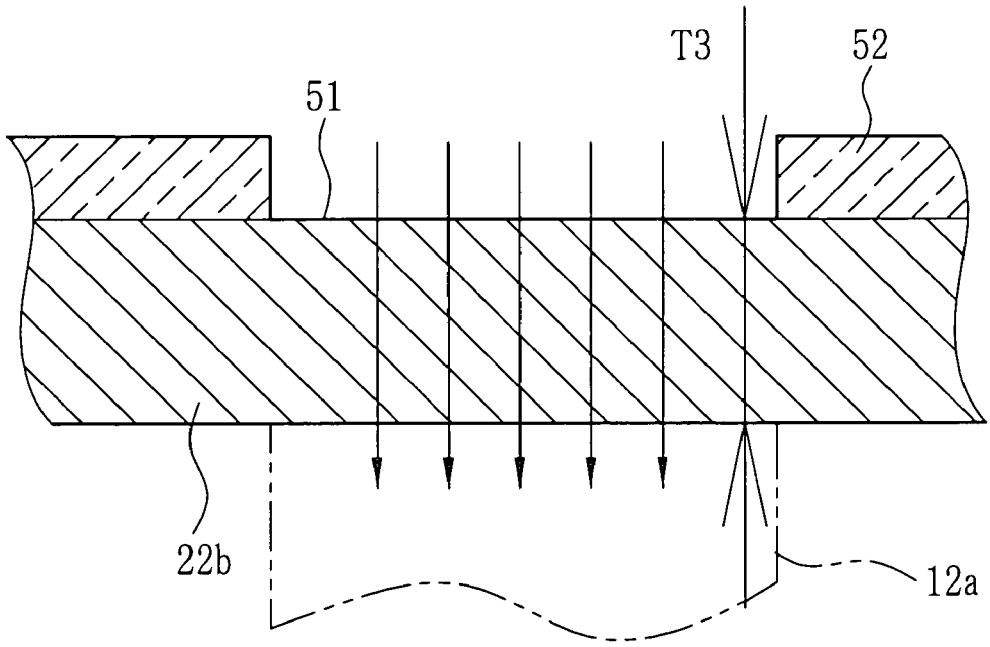
FIG. 6 is a fragmentary sectional view illustrating an ink outlet of the ink cartridge of FIG. 2.

Although the ink outlet 34 is an opening in the above embodiment, it is possible to form an ink outlet 51 as a thin wall part of a bottom wall 22*b*, as shown in FIG. 6. The ink percolates through the ink outlet 51, to be supplied to the ink supply opening 12*a* of the recording head 12. Thus, the ink outlet 51 doubles as a filter. To make the ink outlet 51 water-permeable, the inner surface of the ink outlet 51 is excluded from the coating of the water repellant material. It is possible coating once the entire inner surfaces of the ink chamber with the water repellent layer 52 and then remove the water repellant layer 52 from the inner surface of the ink outlet 51. The ink outlet 51 has a thickness T3 that permits the ink penetrating through it. The value T3 varies depending upon the quality of the paper used as the material of the box 22. Forming the ink outlet 51 as the thin wall part of the box 22 makes it unnecessary to mount a separate filter in the ink outlet, and thus reduces the number of parts of the ink cartridge.

Figure 7:
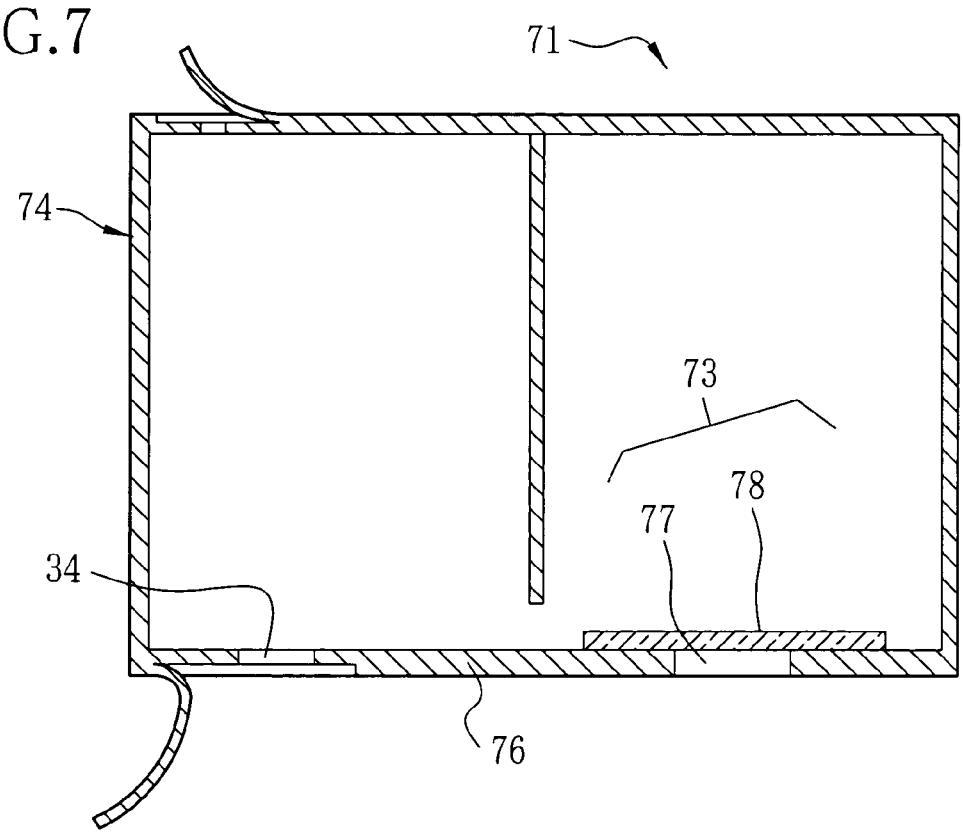
FIG. 7 is a schematic sectional view of an ink cartridge according to another embodiment of the invention, wherein an ink run-out detection window consists of an opening covered with a translucent sheet.

In an alternative shown in FIG. 7, an ink run-out detection window 73 is constituted of an opening 77 formed through a bottom wall 76 of a box 74 of an ink cartridge 71, and a light-permeable sheet 78 covering the opening 77. As the light-permeable sheet 78, a translucent paper with a high transparency is preferably used. Light-permeability of paper depends on how many gaps are there between fibers of the paper. By pounding pulp enough to make it viscous before a dewatering process for making paper, fibers will densely intertwine with each other, reducing gaps between the fibers of the subsequent paper. Then the amount of air entering the gaps of the paper is reduced, so the transparency of the paper becomes higher. The translucent paper preferably has a thickness of about 30 g/m$^2$ to 160 g/m$^2$ in basis weight. Using the highly transparent translucent papers as the light-permeable sheet 78 improves accuracy of detection because of its higher light-permeability in comparison with the first embodiment where the ink run-out detection window 36 is a thin wall part of the box 22. This embodiment also reduces the environmental load of the ink cartridge 71 in comparison with a case where a plastic film is used instead.

Figure 8:
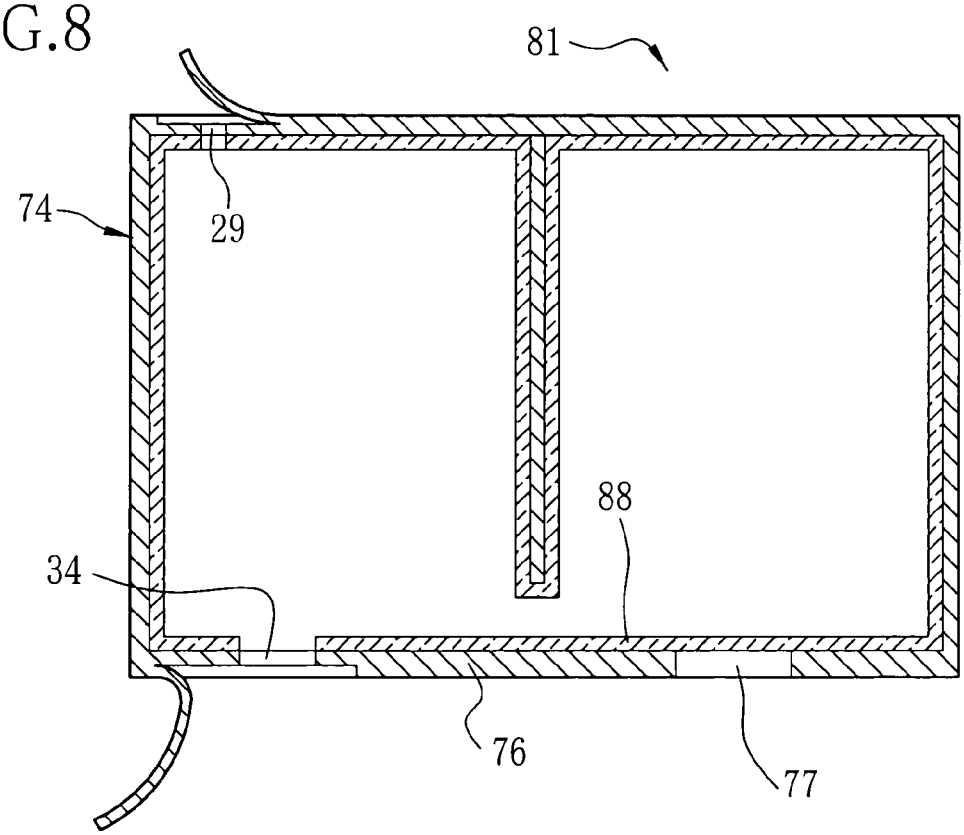
FIG. 8 is a schematic sectional view of an ink cartridge according to a third embodiment of the invention, wherein translucent paper is laid on all internal surfaces of an ink chamber.

It is alternatively possible, as shown in FIG. 8, to put a light-permeable sheet 88, which is formed in the same way as the light-permeable sheet 78, on the all inner surfaces of an ink cartridge 81. Needless to say, the light-permeable sheet 88 is taken off from those parts corresponding to an air inlet 29 and an ink outlet 34. Other features of the ink cartridge 81 may be the same as the ink cartridge 71.

Figure 9:
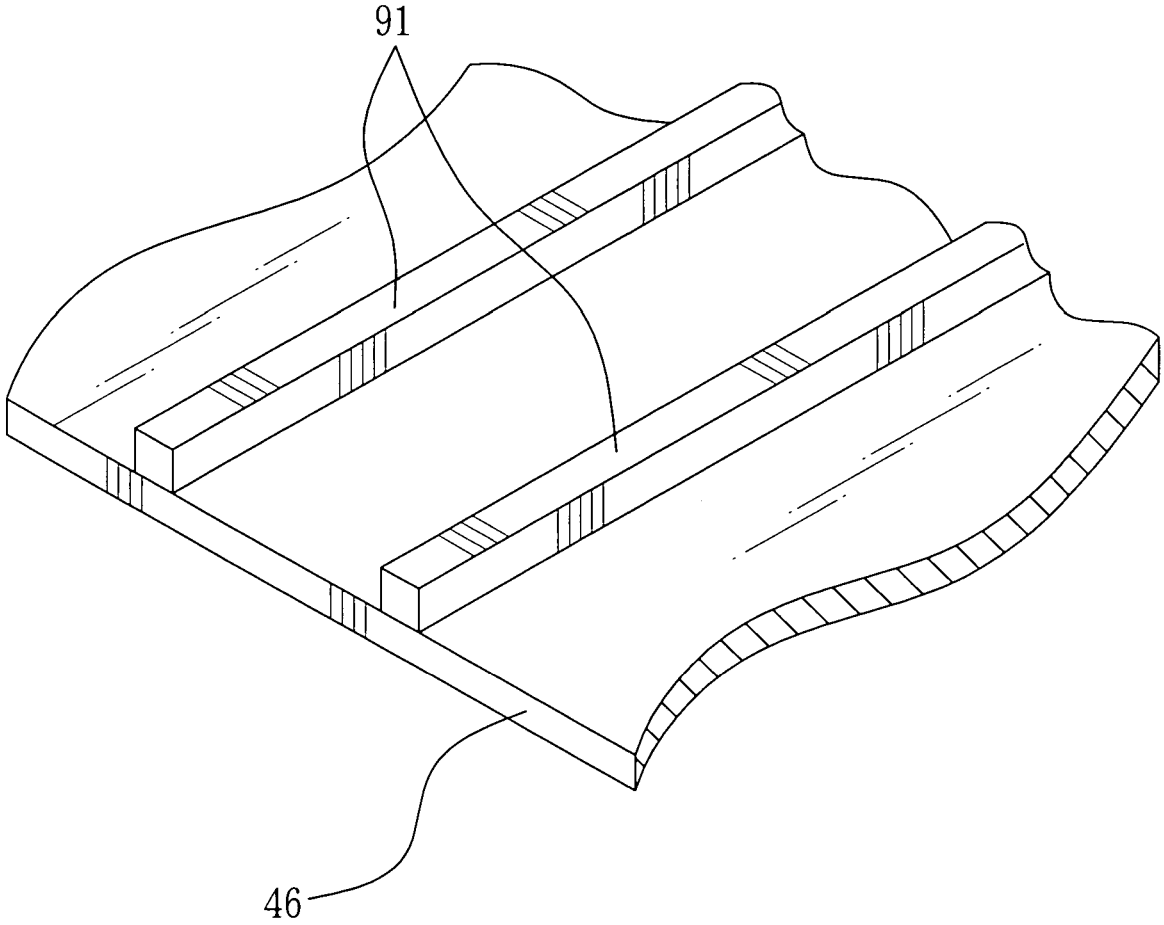
FIG. 9 is an explanatory diagram illustrating reinforcing members for a paper sheet that constitutes the box of the ink cartridge.

In order to make a paper box 22 of an ink cartridge more rigid, a sheet 46 for forming the paper box 22 may be reinforced by providing ribs 91 on the sheet 46, as shown in FIG. 9. The sheet 46 may also be reinforced by cardboard or the like, though it is not shown in the drawings.

Although the above described embodiments relate to the ink cartridge having the ink absorbent chamber and the storage chamber, the present invention is applicable to an ink tank having a single ink chamber.

Although the ink tank of the present invention has been described with respect to the ink cartridges that are formed separately from the recording head and removably attachable to the recording head, the present invention is applicable to a case where at least an ink tank is formed integrally with a recording head.

Thus the present invention is not to be limited to the above-described embodiments, but various modifications will be possible without departing from the scope of claims as appended hereto.

What is claimed is:

1. An ink jet type recording head ink tank, comprising:

a closed paper box formed with an ink chamber for containing the ink, an ink outlet through which the ink is supplied from said ink chamber to said recording head, and an air inlet through which air is introduced into said ink chamber; and an ink absorbent contained in said ink chamber, absorbing and holding the ink by a capillary force, wherein said ink chamber, with said ink absorbed and held in the ink absorbent by the capillary force, has negative pressure, said ink chamber has an ink run-out detection window in a lower peripheral wall of said ink chamber, for detecting that the ink has run out from said ink chamber, and said ink run-out detection window comprises an opening through said lower peripheral wall and a translucent paper sheet covering said opening through said lower peripheral wall.

2. The ink jet type recording head ink tank as claimed in claim 1, wherein said ink chamber is partitioned into an ink absorbent chamber containing said ink absorbent, and a storage chamber storing the ink to be fed to said ink absorbent chamber, by a partition wall extending from a top wall toward a bottom wall of said ink chamber, an interconnection slot is formed through said partition wall in a portion near the bottom of said ink chamber to interconnect said ink absorbent chamber with said storage chamber, and said ink outlet and said air inlet are located on the side of said ink absorbent chamber, wherein the air introduced through said air inlet into said ink absorbent chamber and the ink stored in said ink storage chamber are exchanged through said interconnection slot.

3. The ink jet type recording head ink tank as claimed in claim 2, wherein said closed paper box comprises a folded paper sheet, and said partition wall comprises a paper strip affixed to inside of said closed paper box.

4. The ink jet type recording head ink tank as claimed in claim 1, wherein said ink absorbent comprises unwoven fabric.

5. The ink jet type recording head ink tank as claimed in claim 4, wherein said unwoven fabric is formed from paper.

6. The ink jet type recording head ink tank as claimed in claim 4, wherein said unwoven fabric comprises a combustible cellulose material including natural fiber and reproduced natural fiber.

7. The ink jet type recording head ink tank as claimed in claim 4, wherein said unwoven fabric is folded into concertinas.

8. The ink jet type recording head ink tank as claimed in claim 1, wherein inner wall surfaces of said ink chamber are water repellant.

9. The ink jet type recording head ink tank as claimed in claim 8, wherein said ink outlet is in a bottom of said ink chamber and comprises a non-water repellant thin wall part of a lower peripheral wall of said ink chamber, and the ink percolates through said non-water repellant thin wall part.

10. The ink jet type recording head ink tank as claimed in claim 1, wherein said ink run-out detection window comprises a thin part of said lower peripheral wall, and the thin part of said lower peripheral wall has a thickness that is less than a total thickness of said lower peripheral wall, and that permits light from a light source to pass through.

11. The ink jet type recording head ink tank as claimed in claim 1, wherein said ink jet type recording head ink tank is a removable cartridge.

12. The ink jet type recording head ink tank as claimed in claim 11, wherein said ink outlet and said air inlet are openings through a peripheral wall of said ink chamber and include removable sealing members that are removed to use the ink jet type recording head ink tank.

13. The ink jet type recording head ink tank as claimed in claim 12, wherein said closed paper box comprises a sheet and said sheet comprises a number of paper layers laminated together, and said sealing members comprise cut external ones of a portion of said number of paper layers, the cut external ones of said number of paper layers are located on an outer side of said closed paper box.

14. An ink-jet recording apparatus that records an image by use of an ink jet type recording head, wherein said ink-jet recording apparatus includes an ink tank comprising a closed paper box formed with an ink chamber for containing the ink, an ink outlet through which the ink is supplied from said ink chamber to said recording head, and an air inlet through which air is introduced into said ink chamber; and an ink absorbent contained in said ink chamber, said ink absorbent absorbing and holding the ink by a capillary force, and said ink chamber, with said ink absorbed and held by the capillary force in the ink absorbent, has negative pressure, wherein said ink chamber has an ink run-out detection window in a lower peripheral wall of said ink chamber, for detecting that the ink has run out from said ink chamber, the ink run-out detection window having an opening through said lower peripheral wall and a translucent paper sheet covering said opening through said lower peripheral wall.

15. The ink-jet recording apparatus as claimed in claim 14, wherein said ink tank has an ink run-out detection window in a lower peripheral wall of said ink chamber, and an ink run-out sensor is disposed in a position corresponding to said ink run-out detection window, for detecting optically a residual amount of the ink in said ink chamber.

* * * * *